US011305957B2

(12) United States Patent
Mazzaccherini et al.

(10) Patent No.: US 11,305,957 B2
(45) Date of Patent: Apr. 19, 2022

(54) MACHINE AND METHOD FOR SEALING THE TAIL END OF A LOG OF WEB MATERIAL

(71) Applicant: FABIO PERINI S.P.A., Lucca (IT)

(72) Inventors: Graziano Mazzaccherini, Porcari (IT); Romano Maddaleni, Bientina (IT)

(73) Assignee: Fabio Perini S.p.A., Lucca (IT)

( * ) Notice: Subject to any disclaimer, the term of this patent is extended or adjusted under 35 U.S.C. 154(b) by 478 days.

(21) Appl. No.: 16/318,166

(22) PCT Filed: Jul. 5, 2017

(86) PCT No.: PCT/EP2017/066757
§ 371 (c)(1),
(2) Date: Jan. 16, 2019

(87) PCT Pub. No.: WO2018/015153
PCT Pub. Date: Jan. 25, 2018

(65) Prior Publication Data

US 2019/0284001 A1 Sep. 19, 2019

(30) Foreign Application Priority Data

Jul. 18, 2016 (IT) ..... 102016000075091

(51) Int. Cl.
*B65H 19/29* (2006.01)

(52) U.S. Cl.
CPC . *B65H 19/29* (2013.01); *B65H 2301/414425* (2013.01); *B65H 2301/414446* (2013.01); *B65H 2406/112* (2013.01)

(58) Field of Classification Search
None
See application file for complete search history.

(56) References Cited

U.S. PATENT DOCUMENTS

| | | | | |
|---|---|---|---|---|
| 5,681,421 | A | 10/1997 | Biagiotti | |
| 8,652,283 | B2 | 2/2014 | Gelli et al. | |
| 2010/0101705 | A1 | 4/2010 | Gelli et al. | |
| 2011/0265954 | A1 | 11/2011 | Gelli et al. | |
| 2015/0013887 | A1 | 1/2015 | Ghiselli et al. | |
| 2015/0041045 | A1 | 2/2015 | Gelli et al. | |
| 2015/0191325 | A1* | 7/2015 | Mazzaccherini ..... | B65H 19/29 156/357 |

FOREIGN PATENT DOCUMENTS

| | | | |
|---|---|---|---|
| EP | 0541496 | A1 | 5/1993 |
| EP | 1609534 | A2 | 12/2005 |
| EP | 1609534 | A3 | 9/2007 |
| WO | 2015092078 | A1 | 6/2015 |
| WO | 2015113978 | A1 | 8/2015 |

* cited by examiner

*Primary Examiner* — Barbara J Musser
(74) *Attorney, Agent, or Firm* — Breiner & Breiner, L.L.C.

(57) ABSTRACT

The machine for closing the tail end of logs of web material, includes an advancing path of the logs and, along the log advancing path, a tail end unwinding, positioning and sealing station. The tail end unwinding, positioning and sealing station includes an aperture that extends downwards from an inlet under the log advancing path. At least a first Coanda effect nozzle is placed at the inlet of the aperture, to generate a flow of air adapted to draw into the aperture the tail end of a log that is in the tail end unwinding, positioning and sealing station.

20 Claims, 10 Drawing Sheets

MACHINE AND METHOD FOR SEALING THE TAIL END OF A LOG OF WEB MATERIAL

TECHNICAL FIELD

Disclosed herein are machines for sealing the tail end of logs of web material, for example logs of tissue paper, for producing rolls of toilet tissue, kitchen towels and the like.

BACKGROUND ART

In the paper converting industry, in particular tissue paper, it is frequently necessary to unwind plies of paper from parent reels of large diameter and subsequently rewind one or more plies bonded together into logs having diameters equal to the dimensions of the rolls intended for final consumption and with an axial length equal to the width of the plies unwound from the parent reels. Winding is carried out in machines known as rewinders and the logs produced are subsequently sealed by attaching the tail end to the cylindrical surface of the log, to allow the subsequent operations, in particular cutting into rolls and packaging for sale.

The tail end of the logs is secured to the cylindrical surface of the logs by gluing or, in some cases, by mechanical ply bonding. Machines for sealing the tail end of logs by mechanical ply-bonding are disclosed in U.S. Pat. No. 8,652,283. US 2015/0191325 discloses a machine for sealing the tail end of logs alternatively by gluing or mechanical ply-bonding.

US 2015/0041045, US 2015/0013887, EP 0541496 and U.S. Pat. No. 5,681,421 disclose other machines for sealing the tail end of logs using glue.

Although state of the art machines are very efficient and fast, they have some drawbacks, in particular due to their considerable dimension. This length affects the total length of the converting line. Other inefficiencies are found in machines with suction apertures. These machines require high power due to inevitable losses and are particularly noisy.

Therefore, there is the need for further improvements to machines for sealing the tail end of logs of web material, that entirely or partially overcome the drawbacks of prior art machines.

SUMMARY OF THE INVENTION

According to a first aspect, a machine for sealing the tail end of logs of web material is disclosed, comprising a log advancing path, along which a tail end unwinding, positioning and sealing station is arranged. This tail end unwinding, positioning and sealing station can comprise an aperture that extends downwards from an inlet under the log advancing path. Advantageously, at least a Coanda effect nozzle can be placed at the inlet of the aperture, positioned and arranged to generate a flow of air directed to draw into the aperture the tail end of a log that is in the tail end unwinding, positioning and sealing station.

In this way, a particularly compact machine is obtained.

According to a further aspect, a method for sealing a tail end of logs of wound web material is disclosed herein. The method comprises the following steps: moving the log along an advancing path to a tail end unwinding, positioning and sealing station; while the log is held in the tail end unwinding, positioning and sealing station, unwinding the tail end from the log and inserting the tail end by means of an air jet from at least a first Coanda effect nozzle into an aperture located under the advancing path. The log is turned while it is held in the tail end unwinding, positioning and sealing station, until the tail end of the web material is in a given position. The tail end is subsequently sealed and the log is moved out of tail end unwinding, positioning and sealing station, along the advancing path.

Sealing of the tail end can take place with a mechanical ply-bonding system, or with a gluing system. In this second case, some embodiments comprise a glue applicator assembly positioned at the outlet of the tail end unwinding, positioning and sealing station. Some embodiments can comprise mechanical ply-bonding members and a glue applicator assembly in combination on the same machine. This allows the tail end to be sealed only mechanically or only by gluing.

According to a further aspect, there is provided a machine for sealing the tail end of logs of web material, comprising: a log advancing path; along the log advancing path, a tail end unwinding, positioning and sealing station, comprising an aperture that extends downwards from an inlet under the log advancing path; first mechanical ply-bonding members of the web material and second mechanical ply-bonding members, positioned along said aperture, under the log advancing path. The first mechanical ply-bonding members and the second mechanical ply-bonding members can be arranged distanced from each other at two different distances f the log advancing path, along the extension of the aperture. One of the first and second mechanical ply-bonding members are arranged and configured to form an intermediate fold along a portion of web material, for example typically at a distance approximately equal to the circumferential extension of the log. The others of said first and second mechanical ply-bonding members are configured and arranged to bond the tail end to the intermediate fold by means of mechanical ply-bonding.

In this case, insertion of the tail end into the aperture can take place with a Coanda effect nozzle, or also with a different insertion system, for example by suction.

According to yet another aspect, there is provided a method for sealing a tail end of a log of wound web material, comprising the step of moving the log along an advancing path to a tail end unwinding, positioning and sealing station. In the tail end unwinding, positioning and sealing station, the log is held with its axis in a substantially fixed position and turned to unwind the tail end from the log and insert the tail end, by means of air jets, suction or in any other way, into an aperture located under the advancing path. The log is turned in the tail end unwinding, positioning and sealing station, until the tail end of the web material is in a given position inside said aperture. An intermediate fold is then generated by mechanical ply-bonding along the web material unwound from the log, at a distance from the tail end approximately equal to the circumference of the log. The web material is wound on the log, while keeping the log in the tail end unwinding, positioning and sealing station with its axis substantially stationary, until the tail end is adjacent to the intermediate fold, so as to bond the tail end to the intermediate fold by mechanical ply-bonding. Finally, the log is removed from the tail end unwinding, positioning and sealing station.

Further features and embodiments of the method are described hereunder and in the appended claims, which form an integral part of the present description.

BRIEF DESCRIPTION OF THE DRAWINGS

The invention will be better understood by following the description and accompanying drawing, which shows practical embodiments. More specifically, in the drawing.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
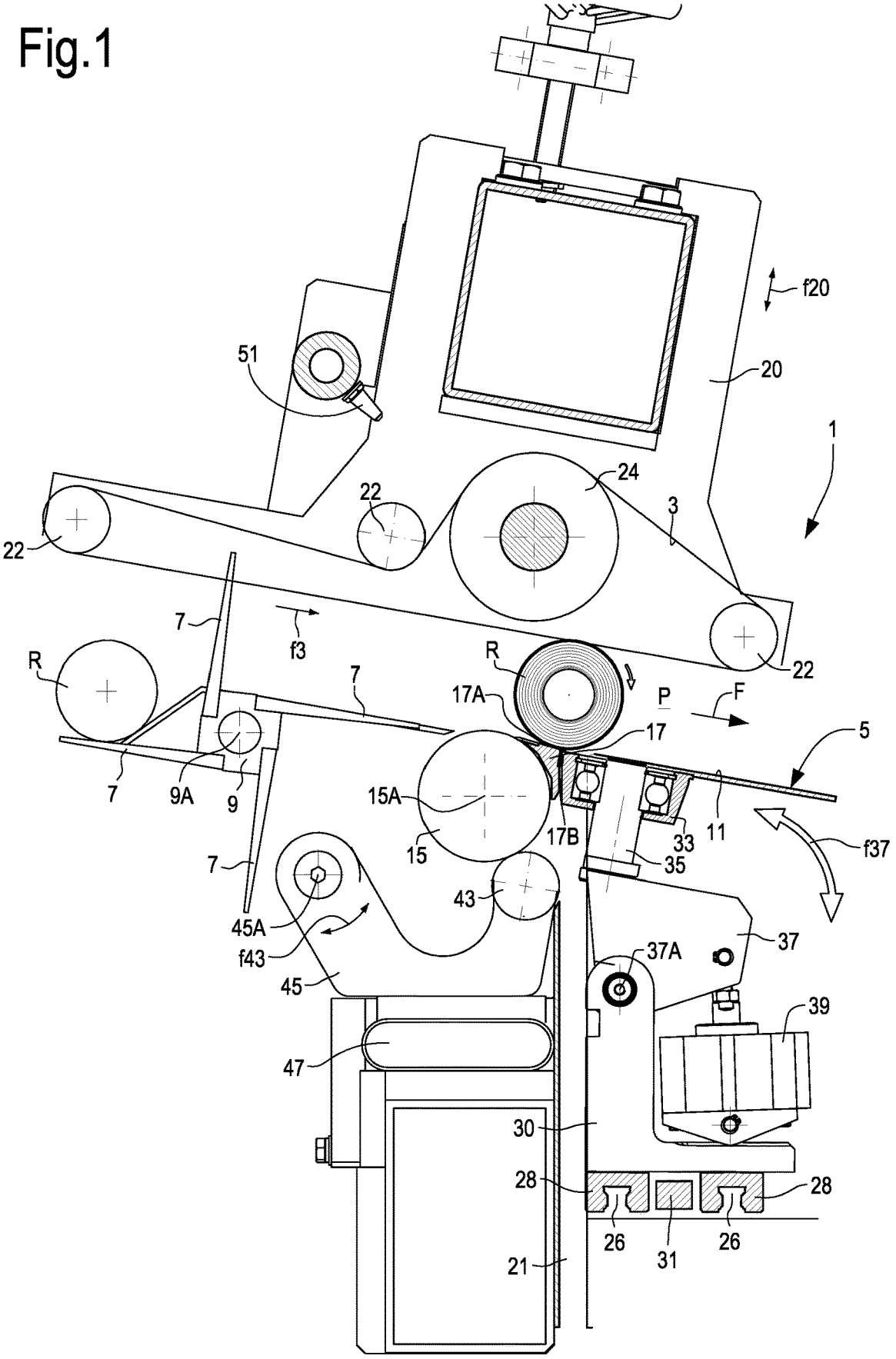
FIG. 1 illustrates a section according to a vertical and longitudinal plane of a machine for sealing the tail end of logs of web material according to the present disclosure.
Figure 2:
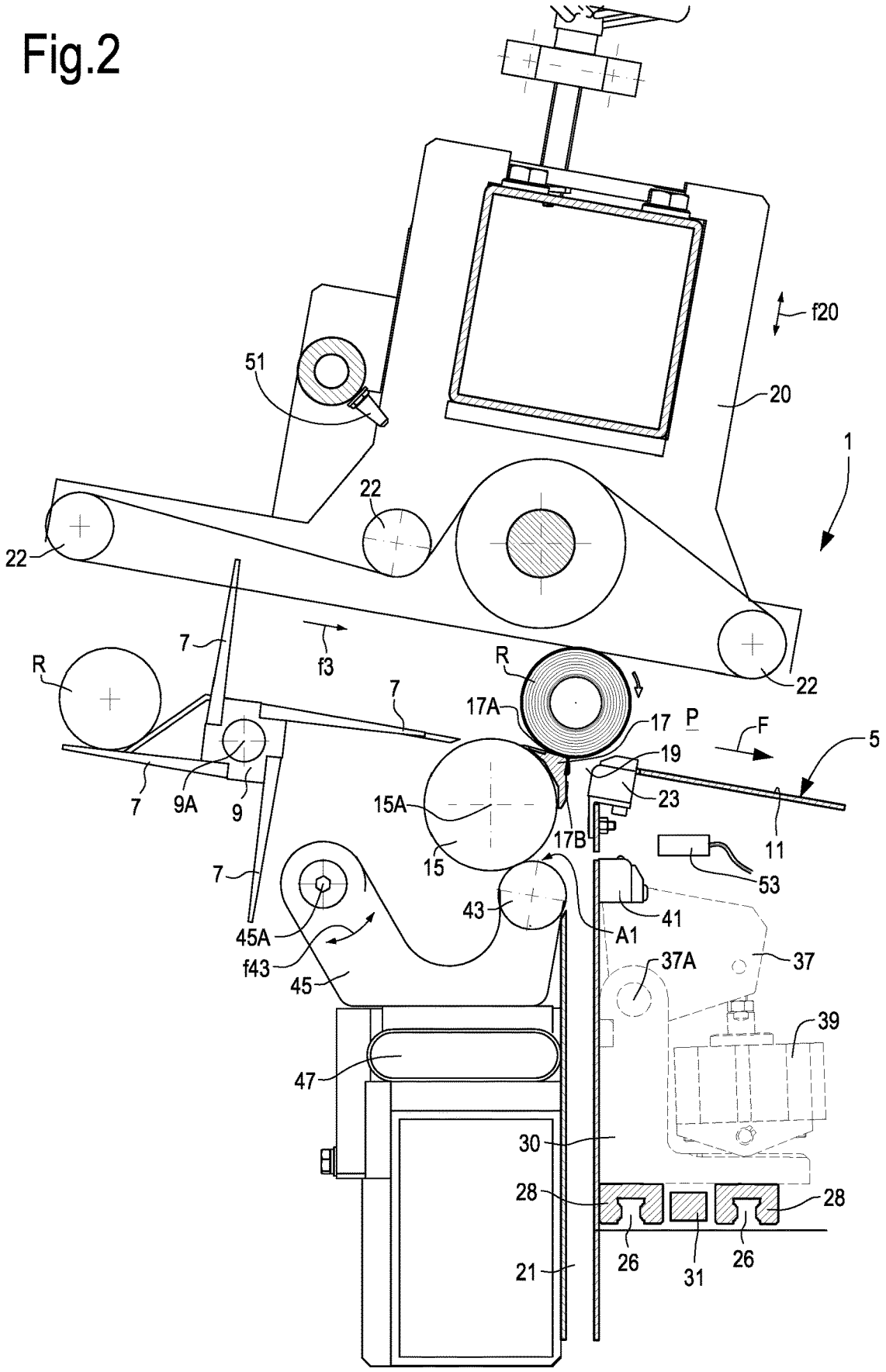
FIG. 2 illustrates a section similar to that of FIG. 1 according to a longitudinal plane parallel to that of FIG. 1.
Figure 3:
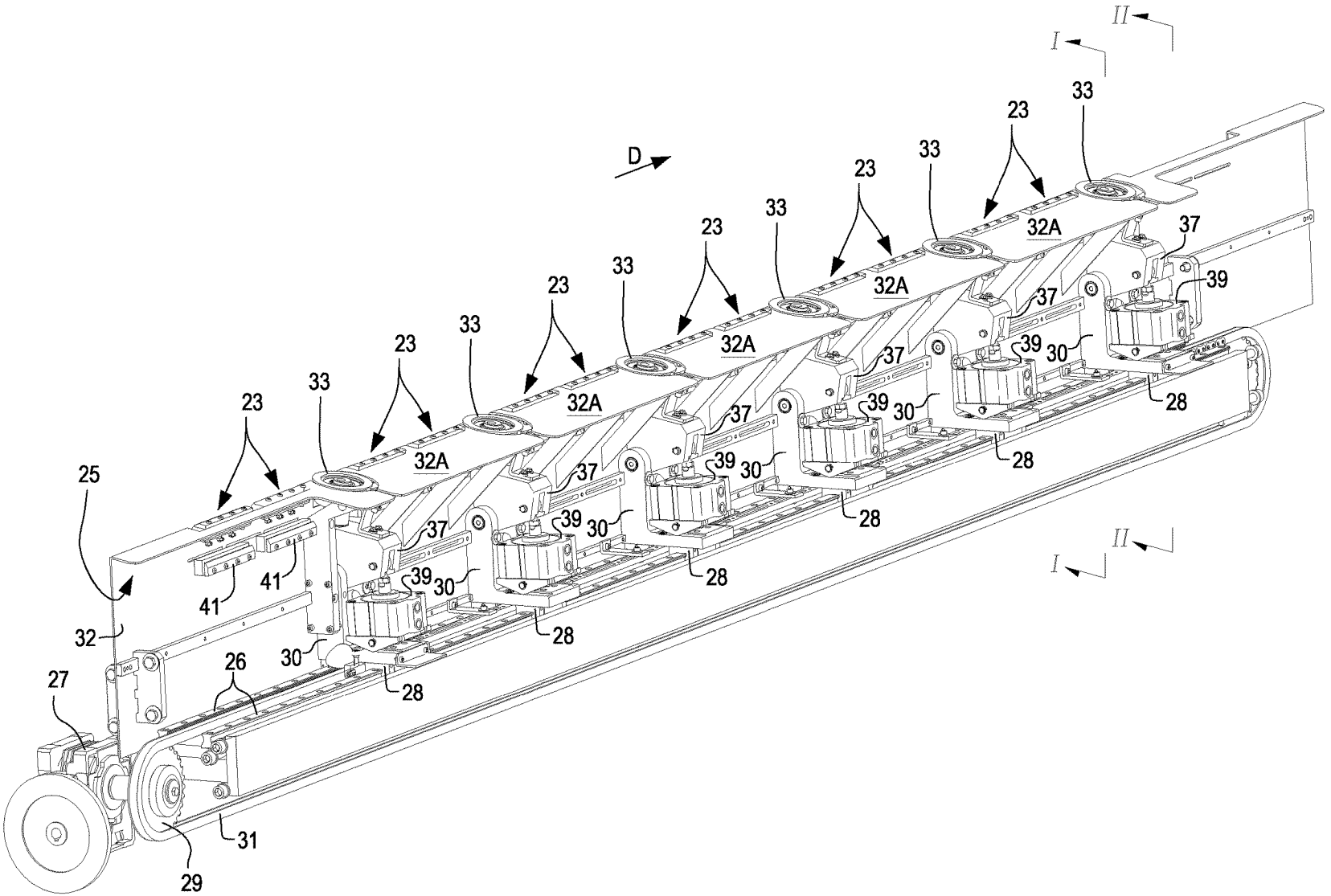
FIG. 3 illustrates an axonometric view of a slide carrying mechanical ply-bonding wheels and Coanda effect nozzles of the machine of FIGS. 1 and 2.

With initial reference to FIGS. 1 to 3, a possible embodiment of a machine for sealing the tail end LF of logs R of web material N is indicated as a whole with 1. The machine 1 comprises an advancing path P for the logs R to be processed. In the embodiment illustrated the advancing path P is defined between a continuous upper flexible member 3, and a lower rolling surface 5. The upper flexible member 3 can comprise a plurality of continuous belts parallel with one another.

The flexible member 3 can be supported by an assembly 20, the position of which is adjustable according to arrow f20 to move towards and away from the rolling surface 5 and adjust the vertical dimension of the advancing path P according to the diameter of the logs R to be processed. The assembly 20 can carry a set of idler wheels 22 on which the flexible member 3 is guided and a drive wheel 24, which controls through a motor, not shown, movement of the flexible member 3 in the two directions indicated by the double arrow f3. Each idler wheel 22 and the drive wheel can consist of a single roller or of a plurality of coaxial pulleys, on each of which a respective continuous belt can be guided, the various continuous belts forming the flexible member 3.

The rolling surface 5 can be partially defined by one of the surfaces 7 of a rotating distributor 9, arranged to rotate about a substantially horizontal axis 9A, approximately at right angles to the advancing path P of the logs R. The rotating distributor 9 rotates according to the arrow f9 to introduce individual logs R into the advancing path P. The logs R can come from a rewinder positioned upstream of the machine 1.

Downstream of the rotating distributor 9, with respect to the direction of advance of the logs R indicated with the arrow F, the rolling surface 5 is defined by a surface 11, for example formed by a sheet or by a plurality of sheets parallel and aligned in the direction of the axis of the logs R.

A tail end unwinding, positioning and sealing station 13 LF of the logs R, described below in greater detail, is arranged between the rotating distributor 9 and the surface 11.

In the illustrated embodiment, a peripheral contact roller 15 of the logs R is provided in the unwinding, positioning and sealing station 13 of the tail end LF of each log R. The peripheral contact roller 15 is arranged with its rotation axis 15A approximately at right angles to the advancing direction F of the logs R in the advancing path P, under the rolling surface 5. The peripheral log contact roller 15 projects with a portion of its cylindrical surface toward the inside of the advancing path P, thereby defining, together with the flexible member 3, a position for holding the logs R in the station 13, for the purposes to be explained below.

A beam or profile 17 is provided adjacent to the peripheral contact roller 15 of the logs R, with a first surface 17A facing the advancing path P and a second surface 17B that extends downwards under the advancing path P and facing downstream with respect to the advancing direction F of the logs R.

An inlet 19 of an aperture 21 that extends downward starting from the advancing path P, under the rolling surface 5 is defined between the profile 17 and the surface 11. The aperture 21 can be defined, for example, in a duct with an elongated rectangular transverse section, the dimension of which in the direction at right angles to the plane of FIGS. 1 and 2 is equal to or greater than the axial length of the log R. In this way, a portion of web material N can be unwound from the log and inserted into the aperture 21. As will be described in detail below, contrary to prior art machines, the tail end of the web material N is inserted in the aperture 21 preferably by means of a laminar air jet, avoiding the use of suction systems.

For this purpose, one or more Coanda effect nozzles 23, the structure of which is illustrated in the sections of FIGS. 2 and 4A-4E and in FIG. 3, are arranged at the inlet 19 of the aperture 21. In the embodiment illustrated, the Coanda effect nozzle 23 is in actual fact divided into a plurality of nozzle sections arranged according to a transverse direction D (FIG. 3) approximately at right angles to the advancing path P. The Coanda effect nozzle 23 is oriented, with respect to the aperture 21 and to its inlet 19, so as to generate a flow of air A oriented from the inlet 19 towards the inside of the aperture 21 to draw into the aperture 21 the tail end LF and a portion of web material N adjacent to the tail end LF, said portion being unwound as described below from the log R located in the unwinding, positioning and sealing station 13.

The various portions of the Coanda effect nozzle 23 can be mounted on a slide 25 provided with a reciprocating movement according to the direction D, controlled by an actuator, for example an electric motor 27 (FIG. 3). This latter turns, with a reciprocating rotary motion a cogwheel 29 around which a chain, a belt or another continuous flexible member 31 is entrained. The slide 25 is constrained to the flexible member 31 to be moved with a reciprocating translatory motion.

The slide 25 is guided on guides 26, engaged on which are pads 28 secured to brackets 30 to which a sheet 32 bent in the shape of an upside down L is secured, to form wings 32A that extend in the advancing direction F of the logs in the advancing path P, to give continuity to the rolling surface 5.

In addition to the Coanda effect nozzle 23, the slide 25 carries a plurality of mechanical ply-bonding wheels 33. The mechanical ply-bonding wheels 33 are arranged between portions of the Coanda effect nozzle 23. In other words, the Coanda effect nozzle 23 is interrupted in various points to accommodate the mechanical ply-bonding wheels 33.

In the illustrated embodiment, as shown also in FIG. 1, which illustrates a section on a vertical plane passing through the rotation axis of one of the mechanical ply-bonding wheels 33, each mechanical ply-bonding wheel 33 is mounted on a respective support shaft 35. The axis B-B of each support shaft 35 is approximately at right angles to the advancing path P of the logs R and is arranged under the rolling surface 5. Each wheel 33 is idly mounted on its shaft 35 to turn on the axis B-B in the steps for sealing the log tail end, as described below.

In the embodiment illustrated, each support shaft 35 is carried by a pivoting bracket 37 hinged about a substantially horizontal axis 37A. For each mechanical ply-bonding wheel 33 and respective pivoting bracket 37, an actuator 39 can be provided, for example a pneumatic actuator. It would also be possible to provide a single actuator to operate more than one mechanical ply-bonding wheel 33, for example also all the mechanical ply-bonding wheels 33.

In the illustrated example, the actuator 39 makes the respective pivoting bracket 37, and therefore the mechanical ply-bonding wheel 33, pivot about the axis 37A according to the double arrow f37 (FIG. 1). FIG. 1 shows, with a continuous line and with a broken line, the two alternative positions that, as a result of the actuators 39, each mechanical ply-bonding wheel 33 can take by pivoting about the axis 37A. In the position shown with broken line, the wheel 33 is at a distance with respect to the surface 17B of the profile 17, so as to allow access to the inlet 19 of the aperture 21 extending under the rolling surface 5.

In some embodiments, a second Coanda effect nozzle 41 is secured to the sheet 32 of the slide 25, positioned under the Coanda effect nozzle 23 and oriented so that the air jet generated thereby is oriented at around 90° with respect to the air jet generated by the Coanda effect nozzle 23.

The second Coanda effect nozzle 41 can also be divided into portions arranged between the mechanical ply-bonding wheels 33. The second Coanda effect nozzle 41 can in actual fact also be divided into a plurality of segments or sections, set at a distance from each other along the direction D.

As can be seen in FIGS. 2 and 4A-4E, the second Coanda effect nozzle 41 is oriented and positioned so that an air jet A1 generated thereby is oriented towards a nip defined between the peripheral log contact roller 15 and a series further mechanical ply-bonding wheels 43. Just as for the first Coanda effect nozzle 23, the second Coanda effect nozzle 41 also generates a laminar air jet. The mechanical ply-bonding wheels 43 can be carried by one or more arms 45 pivoting about a substantially horizontal axis 5A. Preferably, each mechanical ply-bonding wheel 43 is mounted on its own independent arm, so as to be able to pivot independently from the other mechanical ply-bonding wheels. The numeral 47 shows one or more actuators, for example pneumatic actuators, that press the mechanical ply-bonding wheels 43 according to the arrow f43 against the cylindrical surface of the peripheral log contact roller 15. Preferably, if each mechanical ply-bonding wheel 43 is carried by its own pivoting arm 45, an independent actuator 47 is associated with each mechanical ply-bonding wheel 43.

Operation of the machine described above will now be illustrated with specific reference to the sequence of FIGS. 4A-4E.

Figure 4A:
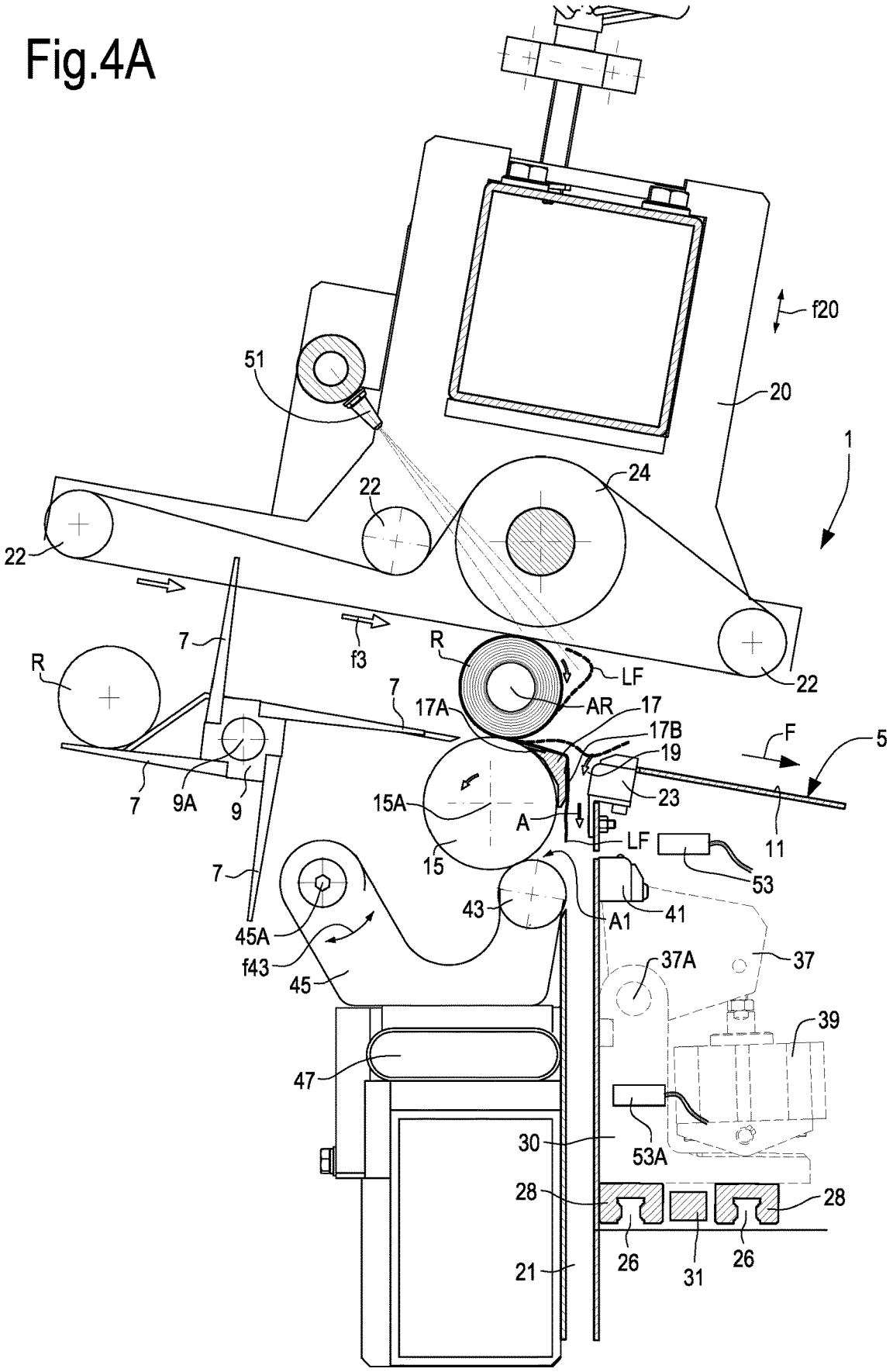
FIGS. 4A to 4E illustrate an operating sequence of the machine of FIGS. 1 to 3.

Referring first to FIG. 4A, a log R has been carried into the tail end unwinding, positioning and sealing station 13, by means of the movement according to the arrow f3 of the flexible member 3. The log R is in a position defined by the flexible member 3 and by the peripheral log contact roller 15. In this position the log R is stopped, keeping its axis AR in a substantially stationary position for the subsequent operating steps. The axis AR of the log is held in the substantially fixed position moving the lower branch of the flexible member 3 at a speed equal to the peripheral speed of the peripheral contact roller 15. These two members move in directions such that the respective contact points of the flexible member 3 and of the roller 15 with the log R have discordant speeds, as indicated by the arrows in FIG. 4A.

Consequently, the log R turns on the axis AR, remaining with said axis in a substantially fixed position. The directions of rotation of the members 3 and 15 are such that the log R turns in the winding direction.

During this step, air jets G that intercept the cylindrical surface of the log R are generated by means of nozzles 51 that can be carried by the assembly 20. During turning of the log R on its axis AR, the tail end LF of the log enters the air current of the air jets G. The air current detaches the tail end LF from the cylindrical surface of the log R and carries said tail end LF over the inlet 19 of the aperture 21.

The generation of a flow of air by the first Coanda effect nozzle 23 positioned in the inlet 19 of the aperture 21 causes the tail end LF to enter said aperture 21, as shown in FIG. 4A, where the tail end LF is shown in three distinct positions that show the movement of the tail end LF under the effect of the air currents generated by the nozzles 51 and by the Coanda effect nozzle 23.

Figure 4B:
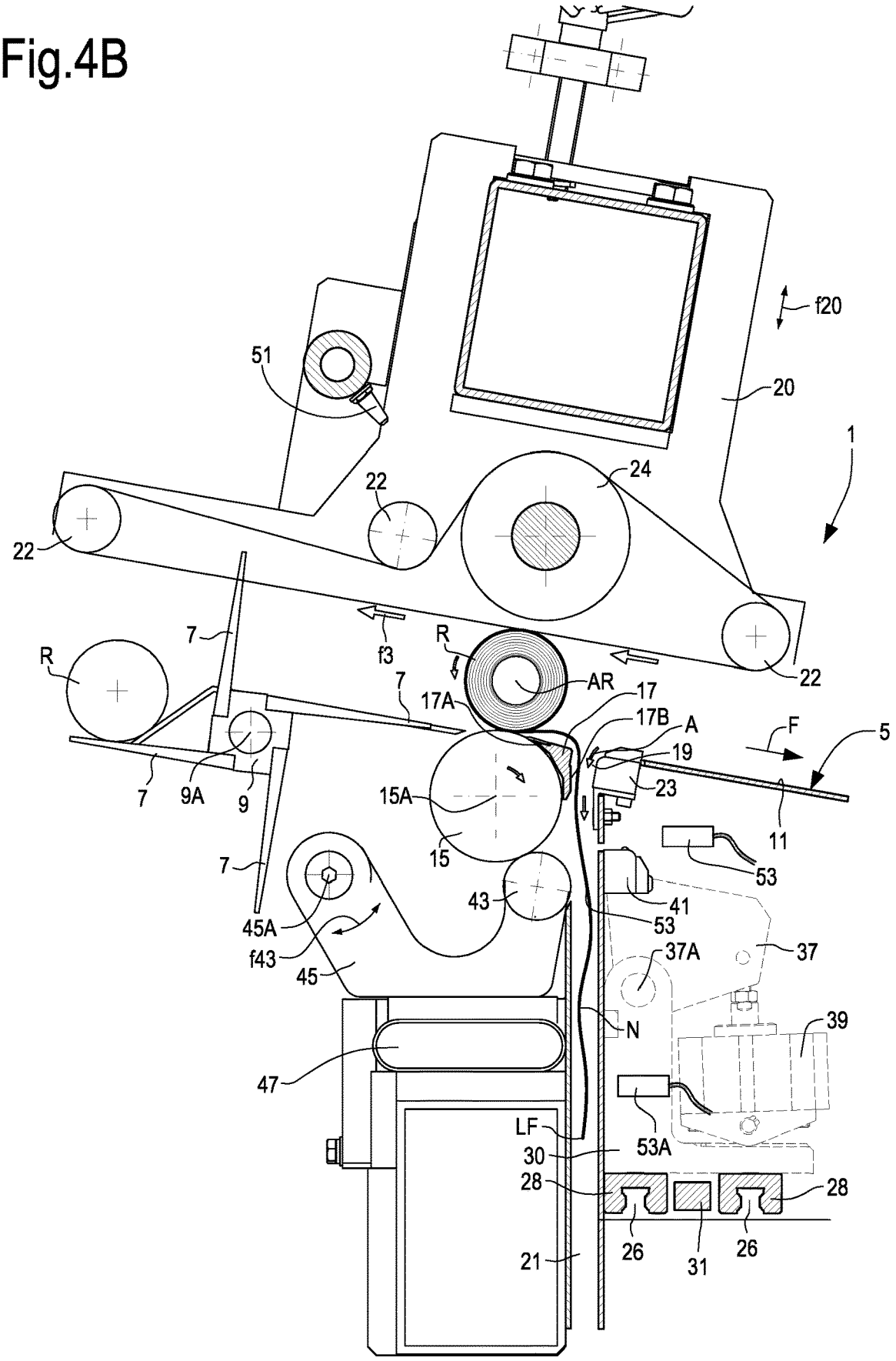

Once the tail end LF has been inserted into the aperture 21, the directions of the movement of the peripheral contact roller 15 and of the flexible member 3 are reversed, as shown by the arrows in FIG. 4B. Consequently, the log R starts to turn in the unwinding direction and, as a result of the air current generated by the first Coanda effect nozzle 23, the tail end LF is pulled into the aperture 21 passing in front of a photocell 53 or other detection member. Unwinding of the log R continues until, based on the signal generated by the photocell 53 and on the angular movement of the peripheral contact roller 15 and/or of the linear movement of the flexible member 3 (which can be detected by an encoder), a suitable length of web material N forming the log R has been unwound inside the aperture 21.

In other embodiments, instead of using the rotation signal of the peripheral contact roller 15 and/or the movement of the flexible member 3, it is possible to determine the length of unwound web material N by means of a second photocell 53A keeping the flexible member 3 moving in the opposite direction with respect to the direction of rotation of the peripheral contact roller 15 and at the same speed as this latter, until the tail end LF has reached the second photocell 53A.

The length of web material N unwound in the aperture 21 allows a fold Np to be formed in the web material by means of the mechanical ply-bonding wheels 43 and the peripheral contact roller 15.

Figure 4C:
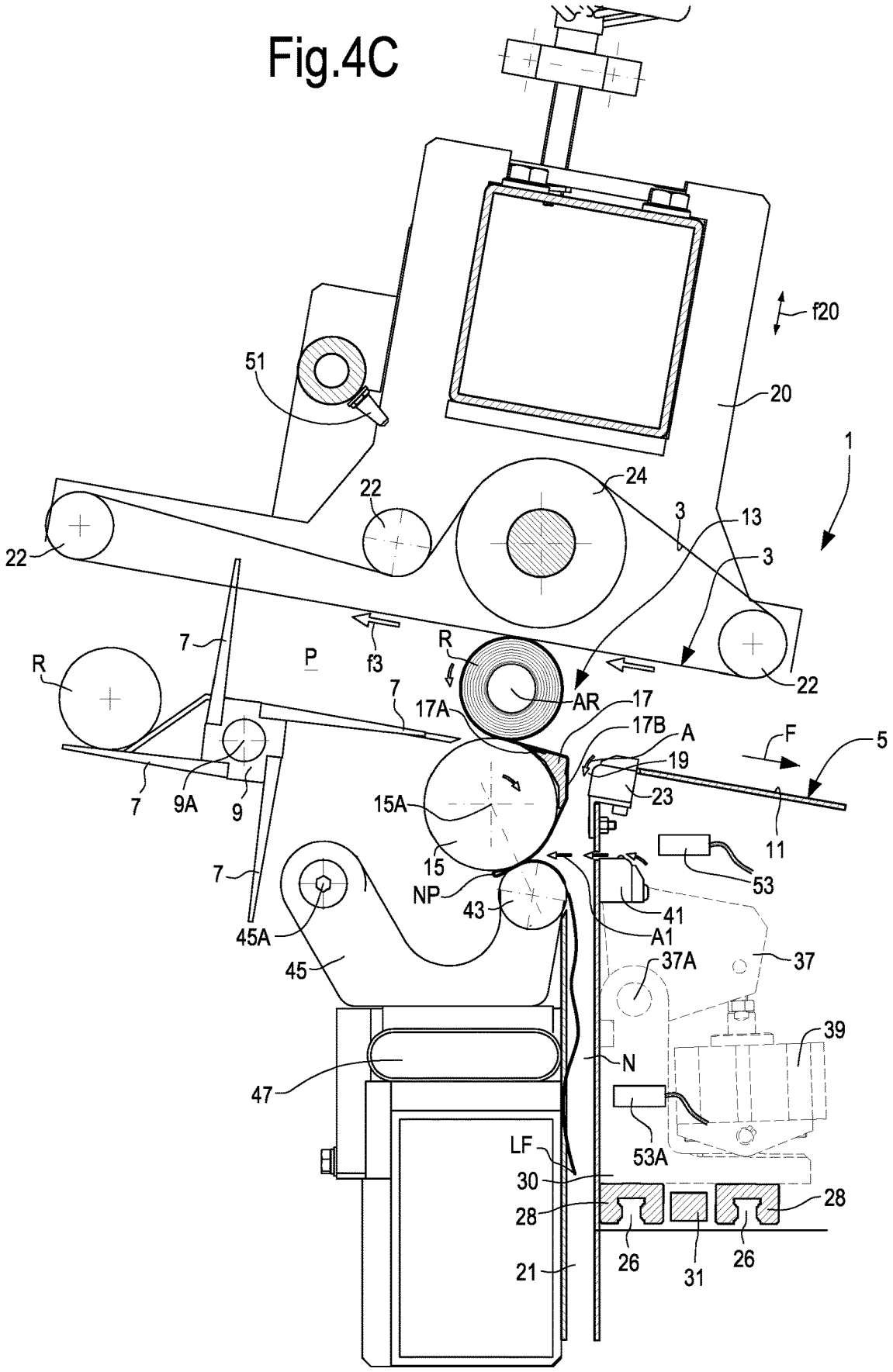

After reaching the amount of web material N unwound in the aperture 21, the peripheral contact roller 15 and the flexible member 3 can continue to move in directions such as to cause further unwinding of web material N, while the second Coanda effect nozzle 41 is activated, as shown in FIG. 4C. The reference A1 indicates the laminar flow of air generated by the second Coanda effect nozzle 41. This flow of air A1 pushes the web material N into the nip between the peripheral log contact roller 15 and the mechanical ply-bonding wheels 43, so as to form, together with the rotation movement of the peripheral contact roller 15, a transverse fold Np. The pressure with which the mechanical ply-bonding wheels 43 press against the roller 15 is such as to mechanically bond the two portions of the fold Np and stabilize said fold. The mechanical ply-bonding wheels 43 can be idly mounted on their axes and drawn into rotation as a result of friction with the peripheral log contact roller 15.

After the web material fold Np has been formed in the mechanical ply-bonding nip, and said fold has been stabilized as a result of mechanical ply-bonding, i.e. of the high pressure between the mechanical ply-bonding wheels 43 and the peripheral contact roller 15, the log R can be rewound. For this purpose, the direction of rotation of the peripheral log contact roller 15 and the direction of movement of the flexible member 3 are reversed so as to rewind the portion of web material N previously unwound inside the aperture 21. After a part of the web material N previously unwound has been rewound on the log R, the peripheral log contact roller 15 can be slowed or stopped, so that the log R starts to roll along the advancing path P as a result of the thrust imparted by the flexible member 3. During this rolling movement, the web material N continues to be rewound.

Figures 4D, 4X:
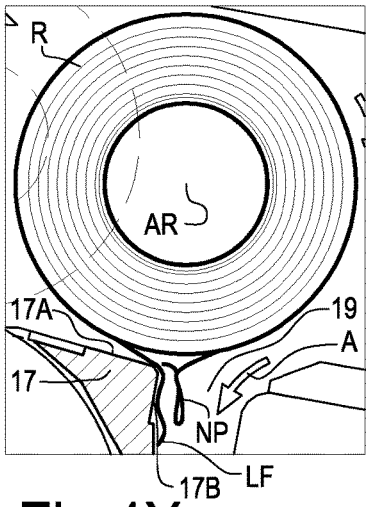
FIG. 4X illustrates an enlargement of a detail of FIG. 4D.

Rewinding of the web material N is controlled so as to move the fold Np and the tail end LF to the inlet 19 of the aperture 21, as shown in FIG. 4D and in the enlargement of FIG. 4X. FIG. 4D shows two different positions of the log R: in the first position shown with a broken line, the log R is still in contact with the peripheral contact roller 15, while in the position shown with a continuous line the log R has lost contact with the peripheral contact roller 15 and is between the flexible member 3 and the upper surface 17A of the beam or profile 17, the surface of which forms part of the rolling surface 5.

To carry the fold Np and the tail end LF to coincide in the position illustrated in FIGS. 4D and 4X, the transverse fold Np is formed at a distance from the tail end LF approximately equal to the circumferential dimension of the log R. In other words, a complete turn of web material N is present between the fold Np and the tail end LF.

Figure 4E:
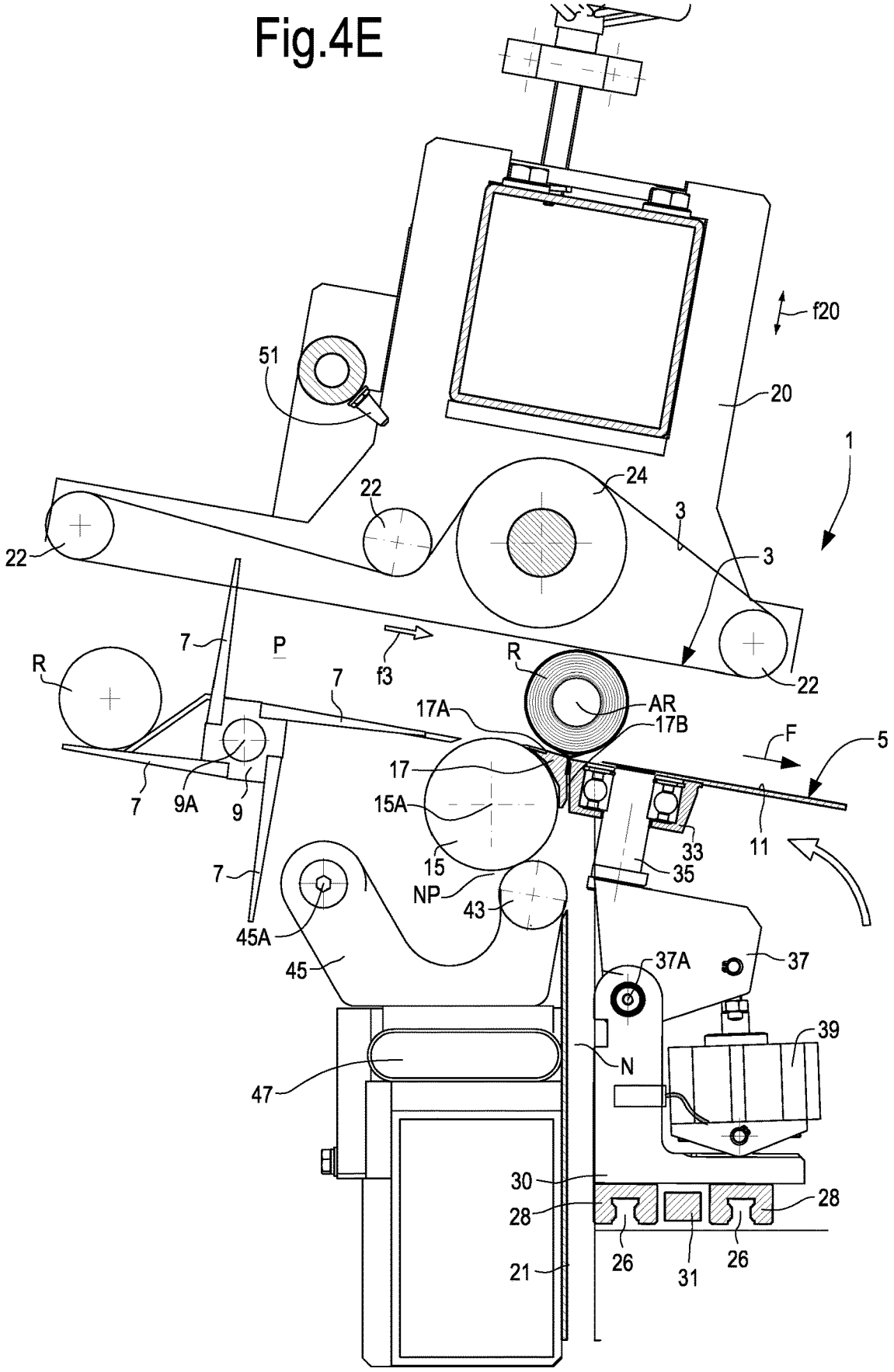

After reaching position of FIG. 4D, the flexible member 3 can be temporarily stopped and the mechanical ply-bonding wheels 33 on the slide 25 are carried to the position of FIG. 4E, pressing against the surface 17B of the profile or beam 17. The surface 17B forms a pressing surface co-acting with the mechanical ply-bonding wheels 33. Once the mechanical ply-bonding wheels 33 have been carried to the pressing position against the surface 17B, the slide 25 translates according to the arrow D (FIG. 3) performing one or more reciprocating strokes. The fold Np and the tail end LF are thus bonded to one another as a result of the pressure between the mechanical ply-bonding wheels 33 and the pressing surface 17B. This pressure mechanically bonds the fold Np and the tail end LF to each other. The reciprocating strokes of the mechanical ply-bonding wheels 33, which roll on the pressing surface 17B, are of a length such as to generate mechanical bonding lines of suitable length in the direction parallel to the axis AR of the log R. In some cases the stroke can be equal to or greater than the pitch between two consecutive mechanical ply-bonding wheels 33, so as to generate a continuous joining line.

After carrying out mechanical joining by mechanical ply-bonding of the tail end LF and the fold Np of web material, the log R can continue its rolling movement and be removed from the unwinding, positioning and sealing station 13. The removal movement is obtained by restarting the flexible member 3.

In the embodiment described above, the tail end is sealed without the use of glue, with an exclusively mechanical system, and with the formation of a fold Np on which the tail end LF is secured so as to form a log R that is easy to open as a result of the presence of the fold of web material projecting from the cylindrical surface of the log R.

Figure 5A:
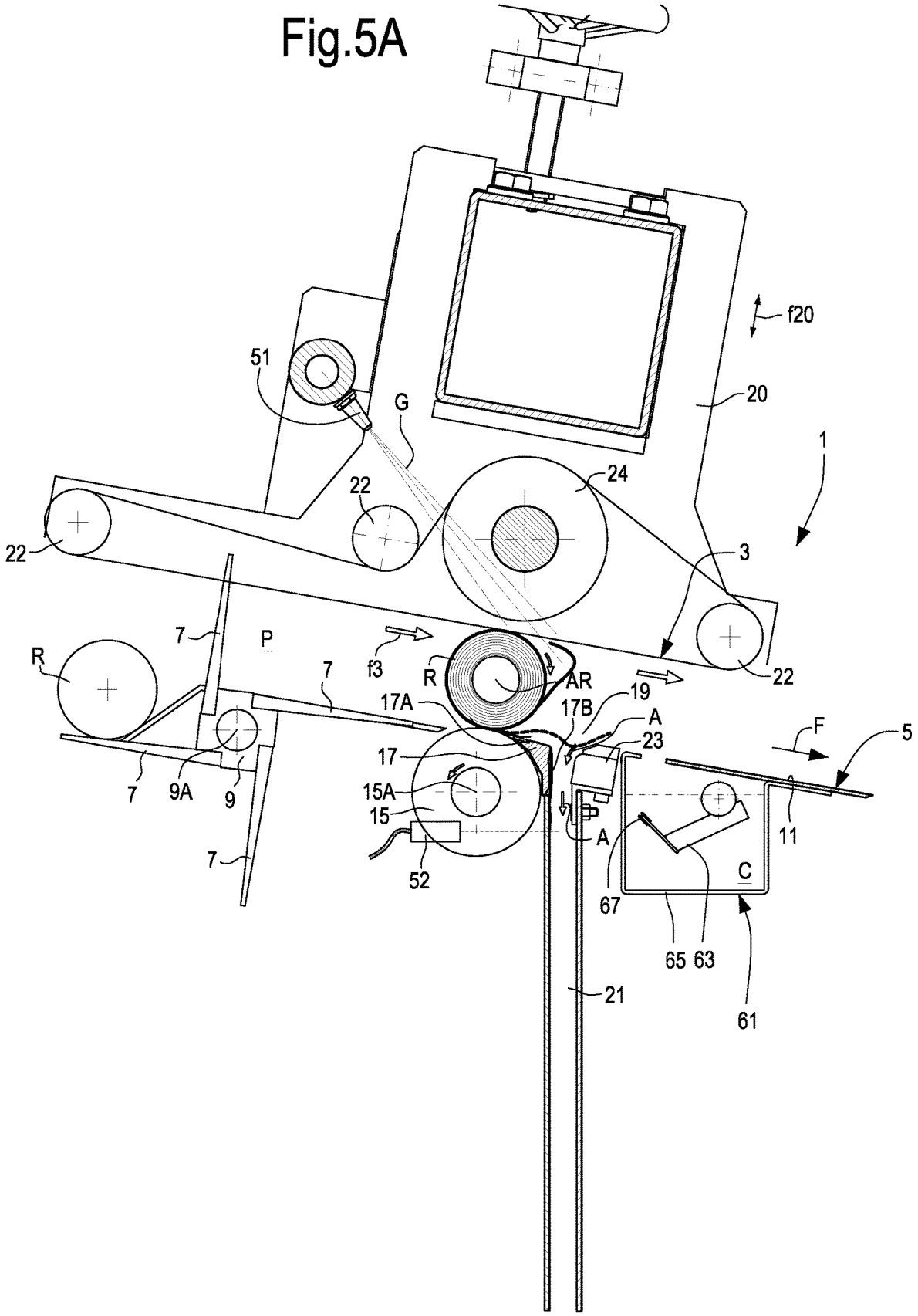
FIGS. 5A and 5B illustrate a second embodiment in two steps of the operating cycle.
Figure 5B:
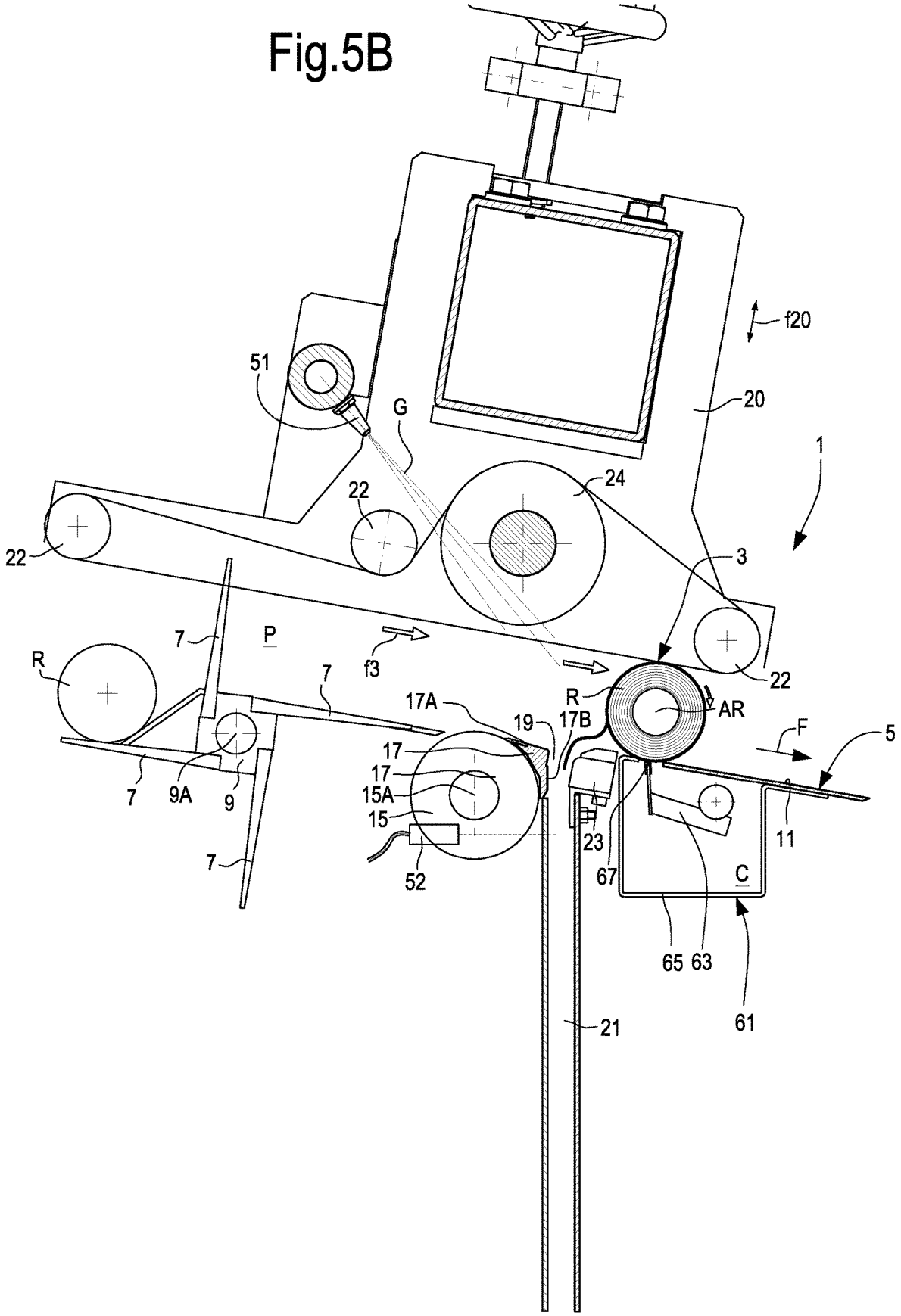

In other embodiments the advantage of a Coanda effect nozzle can be used to insert the tail end LF into the aperture 21 of the machine 1, while performing conventional sealing of the tail end LF using glue. FIGS. 5A and 5B show two steps of operation of a machine, again indicated with 1, for sealing the tail end LF by gluing. The same reference numbers designate parts that are the same as or equivalent to those of the machine in FIGS. 1 to 4E. These parts are not described in detail again.

In the embodiment of the FIGS. 5A and 5B both the mechanical ply-bonding wheels 33, and the mechanical ply-bonding wheels 43 are dispensed with. The slide 25 can also be omitted. Moreover, a single Coanda effect nozzle 23 is provided, which can be mounted in a stationary position close to the inlet 19 of the aperture 21, while the second Coanda effect nozzle 41 is dispensed with.

A glue dispenser 61, comprising a glue dispenser member 63, is positioned along the surface 11 forming part of the rolling surface 5 downstream of the unwinding, positioning and sealing station 13. In the illustrated embodiment, the glue applicator 61 comprises a reservoir 65 containing glue C into which a blade 67 or other applicator element, which is part of the glue dispenser member 61, is periodically immersed. In a known manner, the blade 67 can be moved to the slot or aperture 69 positioned along the rolling surface 5, when the log R requires to be glued.

FIG. 5A shows the opening step of the tail end LF by means of the air jets G generated by the nozzles 51 carried on the assembly 20, while the flexible member 3 and the peripheral contact roller 15 of the logs R move according to the arrows indicated in the figure, keeping the log R turning in the direction of winding, with the axis AR of the log in a stationary position.

A photocell 52 detects the position of the tail end LF when this is inserted into the aperture 21 as a result of the air current generated by the Coanda effect nozzle 23. The position of the tail end LF can be reached by turning the log R always and only in the winding direction, or by reversing the rotation in the unwinding direction, if the tail end LF does not reach the photocell 52 as a result of detachment of the tail end LF from cylindrical surface of the log R alone.

Once the tail end LF has reached the position defined by the photocell 52, the peripheral contact roller 15 can be stopped, while the flexible member 3 continues to move according to the arrows indicated in FIGS. 5A and 5B, causing rolling of the log R along the surface 5 over the slot or aperture 69 in which the blade 67 has in the meantime been positioned (FIG. 5B). In this way, a line of glue is applied to the cylindrical surface of the log R, while the log R is rolling on the rolling surface 5. Rolling also causes rewinding of the tail end LF, which will cover the line of glue applied by the blade 67.

In the embodiment of FIGS. 5A and 5B, gluing of the tail end LF takes place in a substantially known manner, but positioning of the tail end LF in the aperture 21 occurs in a much simpler and more efficient manner with respect to prior art machines, through the use of the Coanda effect nozzle 23.

Instead of a glue applicator 61 of rolling type (i.e., in which the glue is applied to the log when the latter rolls onto a position in which the glue has been placed, for example by means of a blade or by means of an overflow nozzle or the like) a glue applicator of different type can be provided, for example with a nozzle or a series of fixed or moving nozzles, which can be oriented to apply the glue to the unwound tail end and/or to the cylindrical surface of the log. In some embodiments, glue nozzles can be mounted on a slide similar to the slide 25. The glue nozzles can be mounted on the slide 25 along with the mechanical ply-bonding wheels 33 and be used in combination with or alternatively to the mechanical ply-bonding wheels.

In some modified embodiments, the machine 1 can comprise the mechanical ply-bonding members formed by the wheels 33 and by the surface 17B and/or the mechanical ply-bonding members formed by the peripheral log contact roller 15 and by the mechanical ply-bonding wheels 43, in combination with a glue applicator, of the type shown in FIGS. 5A, 5B, or another type of glue applicator. In this case, it is possible to use the mechanical ply-bonding members to form a fold stabilized along the tail end, in substance doubling the thickness of the web material, which is folded over itself in the end area. Once the tail end has been folded by means of the mechanical ply-bonding members, the folded tail end can be sealed by gluing.

For example, the machine can be devoid of mechanical ply-bonding wheels 33 and can be provided with only the mechanical ply-bonding wheels 43, in combination with glue dispenser nozzles carried by the slide 25. In this case, the machine can carry out tail end sealing, for example by folding the tail end with the mechanical ply-bonding wheels 43 co-acting with the peripheral log contact roller 15 and then sealing the tail end by gluing. Alternatively, if the production of logs that are easy to open, having a doubled over tail end, is not required, the mechanical ply-bonding members remain inoperative. Instead of nozzles mounted on the slide 25, this can be omitted, and a glue dispenser such as in FIGS. 5A, 5B can be provided instead.

A machine equipped with both the mechanical ply-bonding members and the glue dispenser in combination can operate according to any one of the methods described, offering high flexibility.

In the light of the exemplary embodiments described above, the indications set forth below in particular form the subject-matter of the foregoing description:

Clause 1. A machine for sealing the tail end of a log of web material, comprising: a log advancing path; along the log advancing path, a tail end unwinding, positioning and sealing station, comprising an aperture that extends downwards from an inlet under the log advancing path; wherein at least a first Coanda effect nozzle is placed at the inlet of the aperture, to generate a flow of air that is adapted to draw into the aperture the tail end of a log that is in the tail end unwinding, positioning and sealing station.

Clause 2. Machine as claimed in clause 1, wherein in the tail end unwinding, positioning and sealing station a peripheral log contact roller is provided, controlled and arranged to turn the log in a winding direction, the peripheral log contact roller being located under the log advancing path.

Clause 3. Machine as claimed in clause 1 or 2, comprising members for mechanical ply-bonding of the web material, positioned in the aperture, under the log advancing path.

Clause 4. Machine as claimed in clauses 2 and 3, wherein the mechanical ply-bonding members comprise the peripheral log contact roller.

Clause 5. Machine as claimed in clause 4, wherein the mechanical ply-bonding members further comprise at least a ply-bonding wheel co-acting with the peripheral log contact roller.

Clause 6. Machine as claimed in clause 3, 4 or 5, comprising at least a second Coanda effect nozzle in said aperture, to draw the web material towards the mechanical ply-bonding members.

Clause 7. Machine as claimed in clause 6, when dependent on at least clause 5, wherein said second Coanda effect nozzle is arranged to draw the web material into a nip formed by the peripheral log contact roller and the mechanical ply-bonding wheel.

Clause 8. Machine as claimed in one or more of clauses 3 to 7, wherein second mechanical ply-bonding members are associated with the inlet of the aperture.

Clause 9. Machine as claimed in clause 8, wherein the second mechanical ply-bonding members comprise pressure members associated with the first Coanda effect nozzle, on one side of the aperture and co-acting with a pressing surface positioned on a second side of the aperture.

Clause 10. Machine as claimed in clause 9, wherein the pressure members comprise a plurality of mechanical ply-bonding wheels idly supported on support shafts approximately at right angles to the log advancing path and aligned transversally with respect to the log advancing path; and wherein the wheel support shafts are movable from a position in which the mechanical ply-bonding wheels are at a distance from the pressing surface, so as to allow access to the aperture, to a position in which the mechanical ply-bonding wheels are pressed against the pressing surface.

Clause 11. Machine as claimed in clause 10, wherein said mechanical ply-bonding wheels are carried by a slide that moves transversally to the log advancing path and approximately parallel to the axis of the logs when these are in the tail end unwinding, positioning and sealing station.

Clause 12. Machine as claimed in clause 11, wherein said at least one first Coanda effect nozzle is positioned on the slide.

Clause 13. Machine as claimed in clause 11 or 12, wherein at least an actuator is carried by the slide, to move the support shafts.

Clause 14. Machine as claimed in one or more of the preceding clauses, comprising a continuous flexible member located over the log advancing path.

Clause 15. Machine as claimed in clause 14, wherein the peripheral log contact roller and the flexible member are arranged and controlled to hold the logs in the tail end unwinding, positioning and sealing station, and to turn the logs on their axis.

Clause 16. Machine as claimed in one or more of the preceding clauses, wherein in said tail end unwinding, positioning and sealing station a blower nozzle is provided, which is positioned above the log advancing path, said nozzle being directed so as to open the tail end of the log that is in the tail end unwinding, positioning and sealing station, and bring it towards the inlet of the aperture.

Clause 17. Machine as claimed in one or more of the preceding clauses, comprising a glue dispenser.

Clause 18. Machine as claimed in clause 17, wherein the glue dispenser is located downstream of the aperture with respect to the log advancing direction along the advancing path.

Clause 19. Machine as claimed in clause 18, wherein the glue dispenser is located under the log advancing path, and has a gluing member positioned and controlled to apply glue to a surface of the log when it advances by rolling along the advancing path over the glue dispenser.

Clause 20. Machine as claimed in clause 17 or 18, wherein the glue dispenser comprises glue nozzles.

Clause 21. A method for closing a tail end of logs of wound web material, comprising the steps of:

moving the log along an advancing path to a tail end unwinding, positioning and sealing station;

holding the log in the tail end unwinding, positioning and sealing station, unwinding the tail end from the log and, by means of an air jet from at least a first Coanda effect nozzle, introducing the tail end into an aperture located under the advancing path;

turning the log in the tail end unwinding, positioning and sealing station, until the tail end of the web material is in a given position;

sealing the tail end and moving the log out of the tail end unwinding, positioning and sealing station.

Clause 22. Method according to clause 21, comprising the steps of:

generating by mechanical ply-bonding an intermediate fold along the web material unwound from the log, at a distance from the tail end approximately equal to the circumference of the log;

rewinding the web material onto the log, while keeping the log in the tail end unwinding, positioning and sealing station, until the tail end is adjacent to the intermediate fold;

joining the tail end to the fold by mechanical ply-bonding;

removing the log from the tail end unwinding, positioning and sealing station.

Clause 23. Method as claimed in clause 21, further comprising the step of applying glue to a cylindrical surface of the log and rewinding the tail end onto the log while the log is removed from the unwinding, positioning and sealing station by rolling along the advancing path.

Clause 24. A machine for closing the tail end of logs of web material, comprising: a log advancing path; a tail end unwinding, positioning and sealing station, comprising an aperture that extends from an inlet under the log advancing path; web material mechanical ply-bonding members, arranged at said aperture, under the log advancing path, configured and arranged to generate an intermediate fold in the web material of the log, at a distance from the tail end.

Clause 25. A machine for closing the tail end of logs of web material, comprising: a log advancing path; along the log advancing path, a tail end unwinding, positioning and sealing station, comprising an aperture that extends downwards from an inlet under the log advancing path; first mechanical ply-bonding members and second mechanical ply-bonding members, associated with said aperture.

Clause 26. Machine as claimed in clause 25, wherein the first mechanical ply-bonding members are placed adjacent to the inlet of said aperture and the second mechanical ply-bonding members are placed along the aperture, under the first mechanical ply-bonding members.

Clause 27. Machine as claimed in clause 24, 25 or 26, wherein at least a first Coanda effect nozzle is placed at the inlet of the aperture, to generate a flow of air that is adapted to draw into the aperture the tail end of a log that is in the tail end unwinding, positioning and sealing station.

Clause 28. Machine as claimed in one or more of clauses 24 to 27, wherein a peripheral log contact roller is provided in the tail end unwinding, positioning and sealing station, the peripheral log contact roller being positioned under the log advancing path.

Clause 29. Machine as claimed at least in clause 28, wherein the second mechanical ply-bonding members comprise the peripheral log contact roller.

Clause 30. Machine as claimed in clause 29, wherein the second mechanical ply-bonding members further comprise at least a ply-bonding wheel, and preferably a plurality of ply-bonding wheels, co-acting with the peripheral log contact roller.

Clause 31. Machine as claimed in at least clauses 25 and 27, comprising at least a second Coanda effect nozzle in said aperture, to draw the web material towards the second mechanical ply-bonding members.

Clause 32. Machine as claimed in clause 31, wherein said second Coanda effect nozzle is arranged to draw the web material into a nip formed by the peripheral log contact roller and the mechanical ply-bonding wheel.

Clause 33. Machine as claimed in one or more of clauses 25, 26, 29, 31 and 32, wherein the first mechanical ply-bonding members comprise pressure members on a side of the inlet of the aperture and co-acting with a pressing surface positioned on a second side of the aperture.

Clause 34. Machine as claimed in clause 33, wherein the pressure members comprise a plurality of mechanical ply-bonding wheels idly supported on support shafts approximately at right angles to the log advancing path and aligned transversally with respect to the log advancing path; and wherein the wheel support shafts are movable from a position in which the mechanical ply-bonding wheels are at a distance from the pressing surface, so as to allow access to the aperture, to a position in which the wheels are pressed against the pressing surface.

Clause 35. Machine as claimed in clause 34, wherein the wheels are carried by a slide that moves transversally to the log advancing path and approximately parallel to the axis of the logs when these are in the tail end unwinding, positioning and sealing station.

Clause 36. Machine as claimed in clause 35, wherein at least a first Coanda effect nozzle is positioned on the slide.

Clause 37. Machine as claimed in clause 35 or 36, wherein at least an actuator is carried by the slide, to move the support shafts.

Clause 38. Machine as claimed in one or more of the preceding clauses, comprising a continuous flexible member located over the log advancing path.

Clause 39. Machine as claimed at least in clauses 28 and 38, wherein the peripheral log contact roller and the flexible member are arranged and controlled to hold the logs in the tail end unwinding, positioning and sealing station, and to turn the logs on their axis.

Clause 40. Machine as claimed in one or more of clauses 1 to 39, wherein in said tail end unwinding, positioning and sealing station a blower nozzle is provided, which is positioned above the log advancing path, said nozzle being directed so as to open the tail end of the log that is in the tail end unwinding, positioning and sealing station, and bring it towards the inlet of the aperture.

Clause 41. A method for closing the tail end of logs of web material, comprising the steps of:

moving a log along an advancing path to a tail end unwinding, positioning and sealing station;

holding the log in the tail end unwinding, positioning and sealing station, unwinding the tail end from the log and inserting the tail end into an aperture located under the advancing path;

turning the log in the tail end unwinding, positioning and sealing station, until the tail end of the web material is in a given position inside said aperture;

generating an intermediate fold, along the web material unwound from the log, at a distance from the tail end approximately equal to the circumference of the log;

rewinding the web material onto the log, keeping the log in the tail end unwinding, positioning and sealing station, with its axis substantially stationary, until the tail end is adjacent to the intermediate fold;

attaching the tail end to the intermediate fold by mechanical ply-bonding;

removing the log from the tail end unwinding, positioning and sealing station.

Clause 42. Method as claimed in clause 41, wherein the tail end is inserted into the aperture by means of an air jet generated by at least a first Coanda effect nozzle.

The invention claimed is:

1. A machine for closing a tail end of a log of web material, comprising:

a log advancing path;

along the log advancing path, a tail end unwinding, positioning and sealing station comprising an aperture that extends downwards from an inlet under the log advancing path, wherein at least a first Coanda effect nozzle is placed at the inlet of the aperture, to generate a flow of air that is adapted to draw into the aperture the tail end of a log that is in the tail end unwinding, positioning and sealing station.

2. The machine as claimed in claim 1, wherein in the tail end unwinding, positioning and sealing station, a peripheral log contact roller is provided, positioned under the log advancing path.

3. The machine as claimed in claim 2, further comprising members for mechanical ply-bonding of web material; positioned along the aperture, under the log advancing path, and wherein the mechanical ply-bonding members comprise the peripheral log contact roller.

4. The machine as claimed in claim 3, wherein the mechanical ply-bonding members further comprise at least a ply-bonding wheel co-acting with the peripheral log contact roller.

5. The machine as claimed in claim 4, further comprising at least a second Coanda effect nozzle in said aperture, to draw the web material towards the mechanical ply-bonding members, and wherein said second Coanda effect nozzle is arranged to draw the web material into a nip formed by the peripheral log contact roller and the ply-bonding wheel.

6. The machine as claimed in claim 1, further comprising mechanical ply-bonding members of web material positioned along the aperture, under the log advancing path.

7. The machine as claimed in claim 6, further comprising at least a second Coanda effect nozzle in said aperture, to draw the web material towards the mechanical ply-bonding members.

8. The machine as claimed in claim 6, wherein additional mechanical ply-bonding members are associated with the inlet of the aperture.

9. The machine as claimed in claim 8, wherein the additional mechanical ply-bonding members comprise pressure members arranged on a first side of the inlet, which co-act with a pressing surface positioned on a second side of the aperture.

10. The machine as claimed in claim 9, wherein the pressure members comprise a plurality of mechanical ply-bonding wheels idly supported on support shafts substantially at right angles to the log advancing path and aligned transversally with respect to the log advancing path; and wherein the wheel support shafts are movable from a position in which the mechanical ply-bonding wheels are at a distance from the pressing surface, so as to allow access to the aperture, to a position in which the mechanical ply-bonding wheels are pressed against the pressing surface.

11. The machine as claimed in claim 10, wherein said mechanical ply-bonding wheels are carried by a slide that moves transversally to the log advancing path and substantially parallel to axis of the logs when these are in the tail end unwinding, positioning and sealing station.

12. The machine as claimed in claim 11, wherein the at least a first Coanda effect nozzle is positioned on the slide.

13. The machine as claimed in claim 11 wherein at least an actuator is carried by the slide, to move the support shafts.

14. The machine as claimed in claim 1, further comprising a continuous flexible member located over the log advancing path.

15. The machine as claimed in claim 14, wherein a peripheral log contact roller and the continuous flexible member are arranged and controlled to hold the logs in the tail end unwinding, positioning and sealing station, and turn the logs on their axis.

16. The machine as claimed in claim 1, wherein in said tail end unwinding, positioning and sealing station a blower nozzle is provided, which is positioned above the log advancing path, said blower nozzle is directed so as to open the tail end of the log that is in the tail end unwinding, positioning and sealing station, and bring the tail end towards the inlet of the aperture.

17. The machine as claimed in claim 1, further comprising a glue dispenser.

18. The method for closing a tail end of logs of wound web material, comprising steps of:

moving a log along an advancing path to a tail end unwinding, positioning and sealing station;

holding the log in the tail end unwinding, positioning and sealing station, unwinding the tail end from the log and inserting the tail end into an aperture located under the advancing path by an air jet from at least a first Coanda effect nozzle located under the advancing path and placed at an inlet of said aperture, wherein the Coanda effect nozzle is adapted to generate a flow of air which is adapted to draw the tail end into the aperture;

turning the log in the tail end unwinding, positioning and sealing station, until the tail end of the web material is in a pre-determined position;

closing the tail end and moving the log out of the tail end unwinding, positioning and sealing station, along the advancing path.

19. The method as claimed in claim 18, further comprising steps of:

generating by mechanical ply-bonding an intermediate fold, along the web material unwound from the log, at a distance from the tail end substantially equal to a circumference of the log;

rewinding the web material onto the log, while keeping the log in the tail end unwinding, positioning and sealing station, until the tail end is adjacent to the intermediate fold;

joining the tail end to the intermediate fold by mechanical ply-bonding;

removing the log from the tail end unwinding, positioning and sealing station.

20. The method as claimed in claim 18, further comprising applying glue to a cylindrical surface of the log, and rewinding the tail end onto the log while the log is removed from the unwinding, positioning and sealing station by rolling along the advancing path.

* * * * *